United States Patent [19]

Smirnoff

[11] Patent Number: 4,907,824

[45] Date of Patent: Mar. 13, 1990

[54] DEVICE FOR WRITING

[76] Inventor: Yakov Smirnoff, 1427 N. Kings Rd., Los Angeles, Calif. 90069

[21] Appl. No.: 245,526

[22] Filed: Sep. 19, 1988

[51] Int. Cl.[4] ..... B42D 17/00

[52] U.S. Cl. ..... 281/45; 281/30; 281/51; 283/117

[58] Field of Search ..... 281/30, 42, 51, 45, 281/43, 44; 283/117

[56] References Cited

U.S. PATENT DOCUMENTS

| | | | |
|---|---|---|---|
| 797,548 | 8/1905 | Bates | 281/30 X |
| 2,192,607 | 3/1940 | Anderson | 281/30 |

FOREIGN PATENT DOCUMENTS

| | | | |
|---|---|---|---|
| 349085 | 5/1905 | France | 281/30 |
| 2603526 | 3/1988 | France | 281/51 |
| 2188282 | 9/1987 | United Kingdom | 281/51 |

*Primary Examiner*—Paul A. Bell

*Attorney, Agent, or Firm*—Ilya Zborovsky

[57] ABSTRACT

A device for writing in a shower or the like has a substantially flat support and a stack of sheets attached to said support and arranged so that the sheets are connected with each other along their upper edge and two lateral edges to prevent penetration of water between the sheets.

11 Claims, 3 Drawing Sheets

DEVICE FOR WRITING

BACKGROUND OF THE INVENTION

The present invention relates to a device for writing in a shower or the like. More particularly it relates to such a writing device which has a support and a plurality of sheets arranged in a stack.

Devices of the above mentioned general type are known in the art. They possess some disadvantages, namely that they cannot be used in condition of a water flow for example in a shower, since the sheets are not water-resistant, water can penetrate between the sheet and cause the growth of bacterial organisms, they are inconvenient to handle by a user in the above-mentioned condition. It is therefore believed to be clear that the device of the known type can be improved to eliminate the above specified disadvantages.

SUMMARY OF THE INVENTION

Accordingly, it is an object of the present invention to provide a device for writing in a shower or the like, which is convenient to use in this condition, in which sheets do not deteriorate under the action of water and do not promote the growth of bacterial organisms.

In keeping with these objects and with others which will become apparent hereinafter, one feature of the present invention resides, briefly stated, in a writing device which has a support attachable by its rear surface to a wall or the like, and a stack of sheets connected with the front surface of the support and formed so that an upper edge and two lateral edges of the sheets and connected to each other in the stack.

When the writing device is designed in accordance with the present invention, water cannot penetrate from above into spaces between the sheets and remain there to promote the growth of bacterial organisms. The sheets are composed of a material which is suitable for writing and at the same time water-resistant, so that the sheets do not deteriorate in water, particularly under the action of water flow in a shower or the like.

The novel features of the present invention are set forth in particular in the appended claims. The invention itself, however, will be best understood from the following description of preferred embodiments which is accompanied by the following drawings.

DESCRIPTION OF A PREFERRED EMBODIMENT

Figure 1:
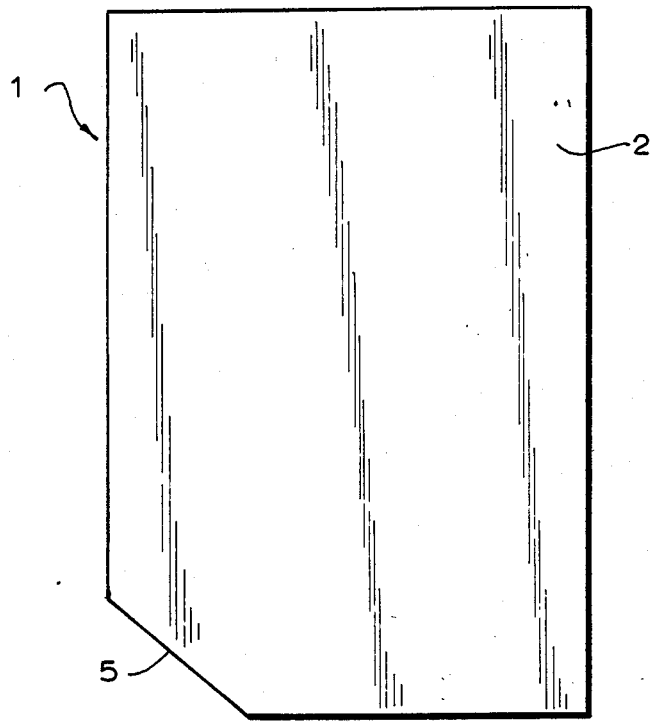
FIG. 1 is a front view of a support of a writing device in accordance with the present invention.
Figure 2:
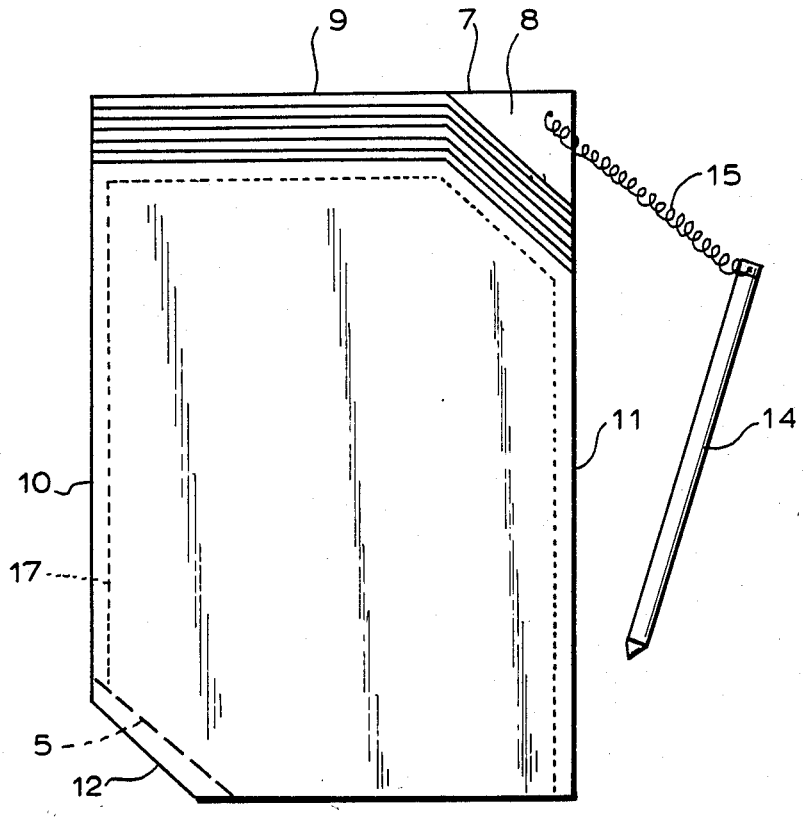
FIG. 2 is a front view of the inventive writing device in an assembled condition.
Figure 3:
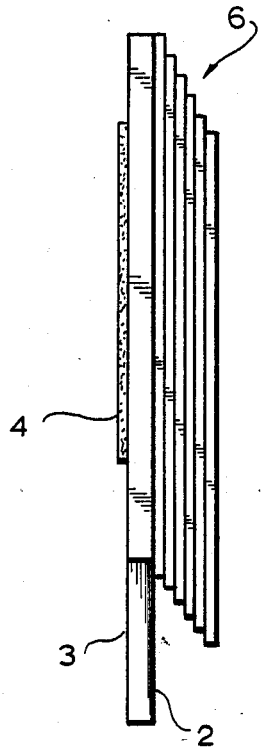
FIG. 3 is a side view of the inventive writing device.

A writing device for writing in a shower or the like has a substantially flat support which is identified with reference numeral 1. The support has a front surface 2 and a rear surface 3. The rear surface 3 is provided with means for attaching the support to a wall or the like in a vertical position. The attaching means can be formed for example as a layer of adhesive 4 which initially is covered with a protective layer which is removed for pressing the adhesive layer 4 against the surface of the wall. It is to be understood that the attaching means can be formed in a different manner as well.

One corner of the support 1, for example the left lower corner is removed so that in this region the support is limited by an inclined edge 5. Generally the support has a rectangular contour, with the exception of the removed corner. The support is formed as a substantially rigid piece of plastic or metal, having a relatively small thickness.

A carrier to be written on is formed as a stack of sheets identified as a whole with reference numeral 6. Each sheet is composed of a water-resistant material such as for example polypropylene, polysterene and the like. One corner of each sheet, for example an upper right corner is removed so as to form an inclined edge 7. Therefore an upper right corner 8 of the support 1 is exposed and sheet-free for the purpose which will be explained hereinbelow. The sheets are connected with one another along their upper edges which include a straight upper edge portion 9 and the inclined edge portion 7, and also along their first lateral edge 10 and second lateral edge 11. The connection is performed for example by means of a water-resistant glue 17. Therefore the spaces between the sheets are open only from below and water cannot penetrate into said spaces. The rearmost sheet of the stack 6 is connected to the support, also for example by a water-resistant glue.

Another corner of each sheet, for example a lower left corner is also removed so as to form an inclined edge. Moreover, the sheets are downwardly offset relative to one another so that a lower edge 13 of each preceding sheet is located lower than the lower edge of each subsequent sheet as considered in the direction toward the support. With such arrangement of the sheets it is very convenient to grasp the uppermost sheet by engaging its lower left portion in the region of the edge 12, so as to lift said sheet and to tear it off from the remaining sheets after writing on said sheet. Moreover, the edges 12 of the sheets are located outwardly beyond the edge 5 of the support, which further facilitates grasping of the respective sheets in the region of the edge 12.

It should be also emphasized that the edges 7 and 12 of each sheet extend parallel to one another and have substantially identical length, so that each sheet is a miror-inverted element and therefore is easy and convenient to manufacture.

A writing instrument such as a pen or a pensil with water-resistant writing medium is further provided in the device. The writing instrument is identified with reference numeral 14 and connected with the support by a connecting element 15. The connecting element 15 can be formed as a metal or plastic wound cord with two opposite ends connected to the writing instrument 14 and to the support 1 respectively. More particularly the latter-mentioned end of the connecting element 15 is connected to the exposed region 8 of the support 1. The connection of both ends of the connecting element 15 can be performed by known means, for example by gluing, mechanical means, etc.

It is believed that the operation of the device does not need a detailed explanation. A user grasps the writing instrument and writes on the uppermost sheet of the stack 6. Then he or she engages the lower left portion of the sheet and separates it from the remaining sheets, to keep said sheet for further use. It is to be understood that the sheets are connected with one another so that they are easily detachable from each other.

The present invention is not limited to the details shown since various modifications and structural changes are possible without departing in any way from the spirit of the invention.

What is desired to be protected by Letters Patent is set forth in particular in the appended claims.

I claim:

1. A device for writing in a shower comprising a substantially flat support having a rear surface arranged to be attached to a substantially vertical wall so as to hold said support in a substantially vertical position, said support also having a front surface;

a carrier to be written on, said carrier being attached to said front surface of said support and including a plurality of sheets in form of a stack such that each of said sheets can be written on and successively removed from said stack after writing, said sheets of said stack being composed of a water-resistant material which does not deteriorate under the action of water and permits writing on said sheets, said stack having upper, lower and two lateral sides when said stack is attached to said support and said support is in said substantially vertical position, said sheets of said stack being connected with one another along said upper side and said two lateral sides so as to prevent penetration of water between said sheets from said upper side and said two lateral sides and at the same time permit gripping of each of said sheets by a user from said lower side; and writing means attached to said support and operative for writing on each of said sheets of said stack successively after one another.

2. A device for writing as defined in claim 1, wherein said sheets of said stack are vertically offset relative to one another so that a lower edge of each preceding sheet is located lower than a lower edge of each subsequent sheet as considered in a direction toward said support.

3. A device for writing as defined in claim 2, wherein one of two lower corners of each of said sheets of said stack is removed so as to facilitate grasping by a user of a sheet in the region of said removed one corner for tearing said sheet off from remaining sheets of said stack after writing on said sheet.

4. A device for writing as defined in claim 1, wherein one of two upper corners of said stack is removed so that a respective one of two upper corners of said support is exposed, said writing means being connected with said support in the region of said exposed one upper corner of said support.

5. A device for writing as defined in claim 4, wherein one of two lower corners of each of said sheets of said stack is removed so as to facilitate grasping by a user of a sheet in the region of said removed one lower corner for tearing said sheet off from remaining sheets of said stack after writing on said sheet, said removed one upper corner and said removed one lower corner being located diagonally opposite to one another.

6. A device for writing as defined in claim 5, wherein each of said sheets of said stack has an inclined edge in the region of said one upper removed corner and an inclined edge in the region of said one lower removed corners, said edges extending paralell to one another and having equal lengths.

7. A device for writing as defined in claim 4, said writing means include a writing element and a connecting element which connects said writing element to said support in the region of said exposed one upper corner of said support.

8. A device for writing as defined in claim 1, wherein said stack of said sheets occupies a major portion of said front surface of said support while a minor portion of said front surface is exposed and stack-free, said writing means being connected with said support in the region of said minor portion of said support.

9. A device for writing as defined in claim 1, and further comprising means for attaching said support to a wall and including connecting means provided on said rear surface of said support.

10. A writing device as defined in claim 9, wherein said connecting means includes an adhesive element attached to said rear surface of said support and adhesively connectable to a wall so as to attach said support to a wall.

11. A writing device as defined in claim 1, wherein said support has at least one removed corner defined by an inclined edge, said sheets of said stack extending outwardly beyond said inclined edge.

* * * * *